US007104716B2

(12) United States Patent
Petit

(10) Patent No.: US 7,104,716 B2
(45) Date of Patent: Sep. 12, 2006

(54) DISTRIBUTOR-APPLICATOR WITH A TWO-COMPARTMENT BODY TYPICALLY FOR MASCARA

(75) Inventor: Robert Petit, Savigny/sur/Orge (FR)

(73) Assignee: Techpack International, Chevilly-Larue (FR)

( * ) Notice: Subject to any disclaimer, the term of this patent is extended or adjusted under 35 U.S.C. 154(b) by 172 days.

(21) Appl. No.: 10/775,148

(22) Filed: Feb. 11, 2004

(65) Prior Publication Data

US 2004/0247372 A1 Dec. 9, 2004

(30) Foreign Application Priority Data

Feb. 14, 2003 (FR) ..... 03 01835

(51) Int. Cl.
*A46B 11/00* (2006.01)

(52) U.S. Cl. ..... 401/129; 401/126; 401/122

(58) Field of Classification Search ..... 401/40, 401/41, 17, 16, 126, 129, 121, 122, 123; 132/317

See application file for complete search history.

(56) References Cited

U.S. PATENT DOCUMENTS 5,002,415 A * 3/1991 Gueret ..... 401/126
5,620,270 A 4/1997 Gueret

FOREIGN PATENT DOCUMENTS

| | | |
|---|---|---|
| EP | 0 701 785 | 3/1996 |
| GB | 2 231 782 | 11/1990 |
| WO | WO 95/12332 | 5/1995 |
| WO | WO 02/062173 | 8/2002 |

* cited by examiner

*Primary Examiner*—David J. Walczak
(74) *Attorney, Agent, or Firm*—Young & Thompson

(57) ABSTRACT

The distributor-applicator mobile in the axial direction includes a body forming a cavity provided with an opening, and an applicator comprising a threaded cap forming a member for gripping the applicator, a rod and an application element:

a) the body comprises a member for forming an axial partition in the cavity so as to form an axial sequence of N staged compartments in the cavity denoted $C_1$ to $C_N$, where N varies from 2 to 4, b) the forming member comprises N−1 separation elements being denoted $S_i$ between two successive compartments, c) each compartment $C_i$, where i>1, comprises a volume forming a storage element for the product, and a free volume forming a communication, such that the application element can access each compartment in order to collect the corresponding products.

32 Claims, 11 Drawing Sheets

22'
240
44
27
4
26
46
24
21
2
25

32
320

21
23
220
22'
A
A
2

C2
2p
1
2e
H1
C1

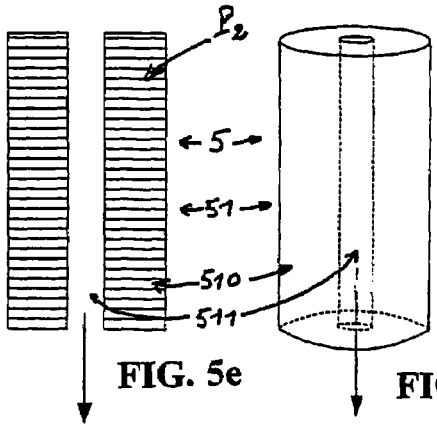
FIG. 5e
FIG. 5f
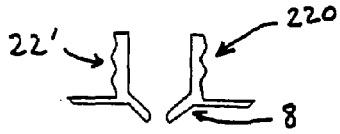
FIG. 5h
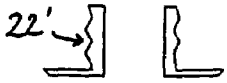
FIG. 5g
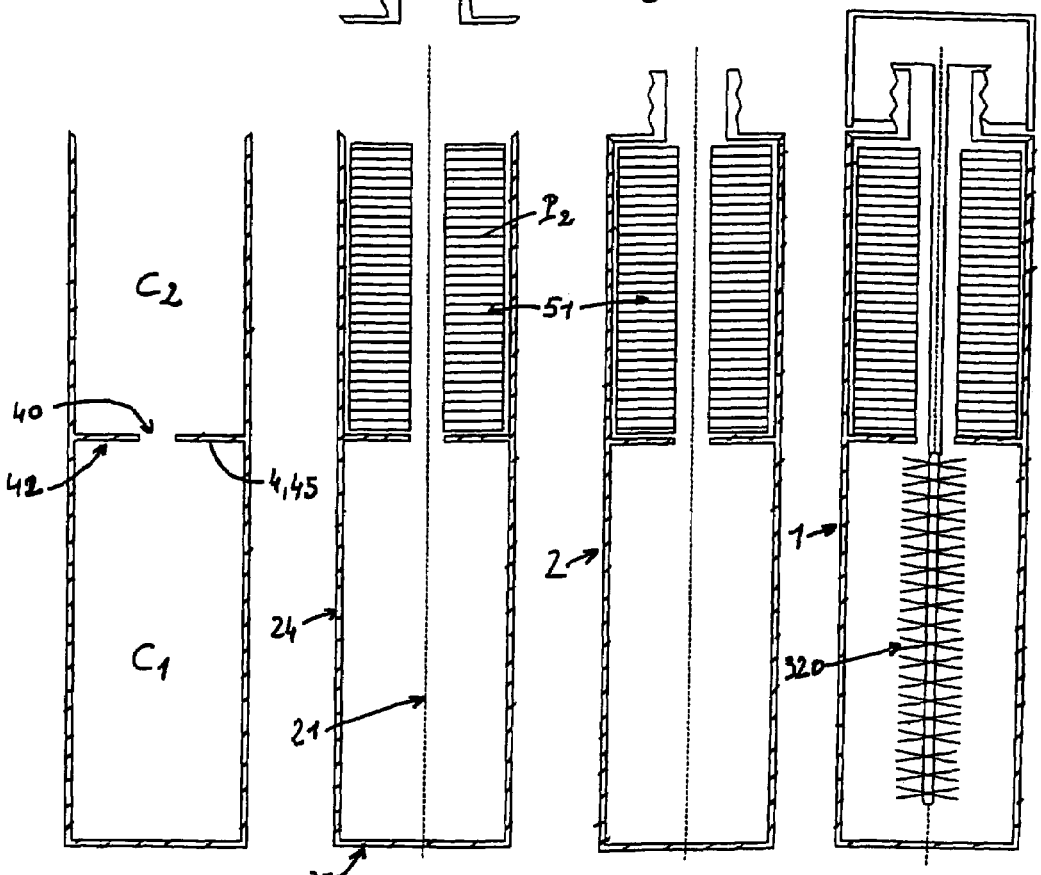
FIG. 5a FIG. 5b FIG. 5c FIG. 5d

DISTRIBUTOR-APPLICATOR WITH A TWO-COMPARTMENT BODY TYPICALLY FOR MASCARA

FIELD OF THE INVENTION

The invention relates to the field of distributors-applicators for cosmetics, and typically distributors-applicators for fluid cosmetics such as mascara.

STATE OF THE ART

Many distributors-applicators for fluid cosmetics comprising an applicator such as a brush, for example like that described in European application No. 94304753.0, are already known.

Typically, these distributors-applicators comprise:

a body containing the said fluid cosmetic with a typically threaded neck, a threaded cap closing off the said neck, the said cap being fixed to a brush that dips in the said fluid cosmetic when the distributor-applicator is typically closed by the said cap, a rod fixing the said brush to the said cap.

Moreover, the neck is typically provided with a wiper ring in order to limit the quantity of fluid cosmetic entrained by the said brush every time that the said brush is removed from the said body.

Problems that Arise

Distributors-applicators according to the state of the art, typically mascara distributors-applicators, are used to distribute and apply a determined fluid product, typically a mascara.

The trend in face make-up, and particularly eye make-up, is towards a search for special effects in terms of colour and in terms of the texture of the deposit formed after application, which typically requires the use of several products. Therefore, the applicant searched for a distributor-applicator capable of packaging at least two separate products so as to halve the number of separate cosmetic packagings, which is a large advantage in practice.

Secondly, in the field of packaging for cosmetics, there is a continuous need to replace distributors-applicators, since the market life of packaging for a make-up product is relatively short.

Thus in some cases, renewal may apply to the application means, typically the brush, in the distributor-applicator. In other cases, it may apply to the addition of new functions, for example as illustrated in European applications No. 94306189.5 and No. 01420087.7.

Therefore, this invention is aimed firstly at renewing the applicators-distributors range, and secondly offering new functions to users.

DESCRIPTION OF THE INVENTION

According to the invention, the axial distributor-applicator designed to contain a cosmetic, typically a mascara, comprises a body forming a typically cylindrical and longitudinal cavity with a height H along its axial direction containing the said cosmetic, and in which there is an opening, the said body being provided with a lateral skirt, fixed with a rim or head at its so-called top end containing a typically threaded neck surrounding the said opening, and typically forming a bottom at its so-called bottom end, and an applicator comprising a typically threaded cap forming a means of gripping the said applicator and intended to cooperate with the said rim or the said neck of the said head, a rod or a longitudinal support and an application means, typically a brush consisting of one or several rows of bristles, the said rod being fixed to the said cap at one of its ends, and fixed to the said application means at its other end, such that the said application means, typically at the contact of the said product typically when the said cap closes off the said opening of the said body, collects some of the said product and after separation of the said applicator from the said body, typically including an axial translation, enables application of the said collected product on a support, and is characterised in that:

a) the said body comprises a means of forming an axial partition in the said cavity so as to form an axial sequence of N staged compartments in the said cavity denoted $C_1$ to $C_N$, where N typically varies from 2 to 4, each compartment $C_i$ with height $H_i$ containing the said cosmetic(s) $P_i$, the said cosmetic(s) $P_i$ typically being different from the said cosmetic(s) $P_{i+1}$ in compartment $C_{i+1}$ located above it, and the said cosmetic $P_i$ being a typically fluid product, b) the said means of forming the said axial partition comprises N−1 separation means S, the said separation means S being denoted $S_i$, where i is equal to not more than N−1, between two successive compartments $C_i$ and $C_{i+1}$, c) each compartment $C_i$, where i>1, comprises a volume forming a storage means for the said product $P_i$, and also a complementary or free volume forming a communication means, such that the said application means can access each of the said compartments $C_i$, where i'<i, in order to collect the said corresponding products $P_{i'}$.

Thus, the body of the distributor-applicator according to the invention comprises a sequence of staged compartments $C_i$ along the axial direction of the said body, each compartment $C_i$ forming a separate cavity that can contain a separate product $P_i$, each compartment and separate cavity opening up directly or indirectly to the outside so that each separate product $P_i$ can be collected, typically using the said application means, and withdrawal of the said application means possibly collecting all separate products $P_i$ for application purposes.

The invention thus solves the problems that arise. Firstly, the distributor-applicator is capable of offering several products $P_i$ in the same packaging including a typically fluid product $P_1$, such that the user has different products $P_i$ in the same packaging with one of these products typically being a fluid product, for example a mascara.

Moreover, it is clear that the distributor-applicator according to the invention considerably modifies the traditional distributor-applicator itself and traditional make-up, to the extent that it is possible to consider that the distributor-applicator according to the invention forms a new generation of distributors-applicators.

DESCRIPTION OF THE FIGURES

All the figures relate to distributors-applicators (1) or distributor-applicator elements according to the invention. Unless mentioned otherwise, the figures are views or axial sections along the centreline of the distributor-applicator (1) according to the invention.

FIGS. 1*a* to 1*c* correspond to a method of the invention in which the cavity (20) of the said body (2) forms two compartments (200) $C_1$ and $C_2$ in which the said separation means is a radial projection (41) in which the central orifice (40) forms a wiping means and that can be closed off by a sealing means (33) forming part of the applicator (3).

FIG. 1*a* shows the closed distributor-applicator (1).

FIG. 1*b* represents the applicator (3) alone.

FIG. 1*c* represents the applicator (3) partially engaged in the body (2).

FIG. 2*a* shows the said body (2) comprising the said add-on part (46), the said add-on part being a section A—A in FIG. 3*a*.

FIG. 2*b* shows the said applicator (3).

FIG. 2*c* represents the said body (2) closed by the said removable head (22'), typically heat-sealed or click-fitted to the skirt (24) of the said body (2).

FIG. 2*d* represents the said distributor-applicator (1), the said body (2) being closed by the said applicator (3).

FIG. 3*a* is a sectional view along section A—A of the add-on part (46) in FIG. 2*c*.

FIG. 3*b* is a side view of the add-on part (46).

Moreover, the said application means (32) comprises two brushes (320, 320') with different diameters, the large diameter brush having a height corresponding approximately to the accumulated height of the two upper compartments (200).

Figures 4A, 4B, 4C, 4D:
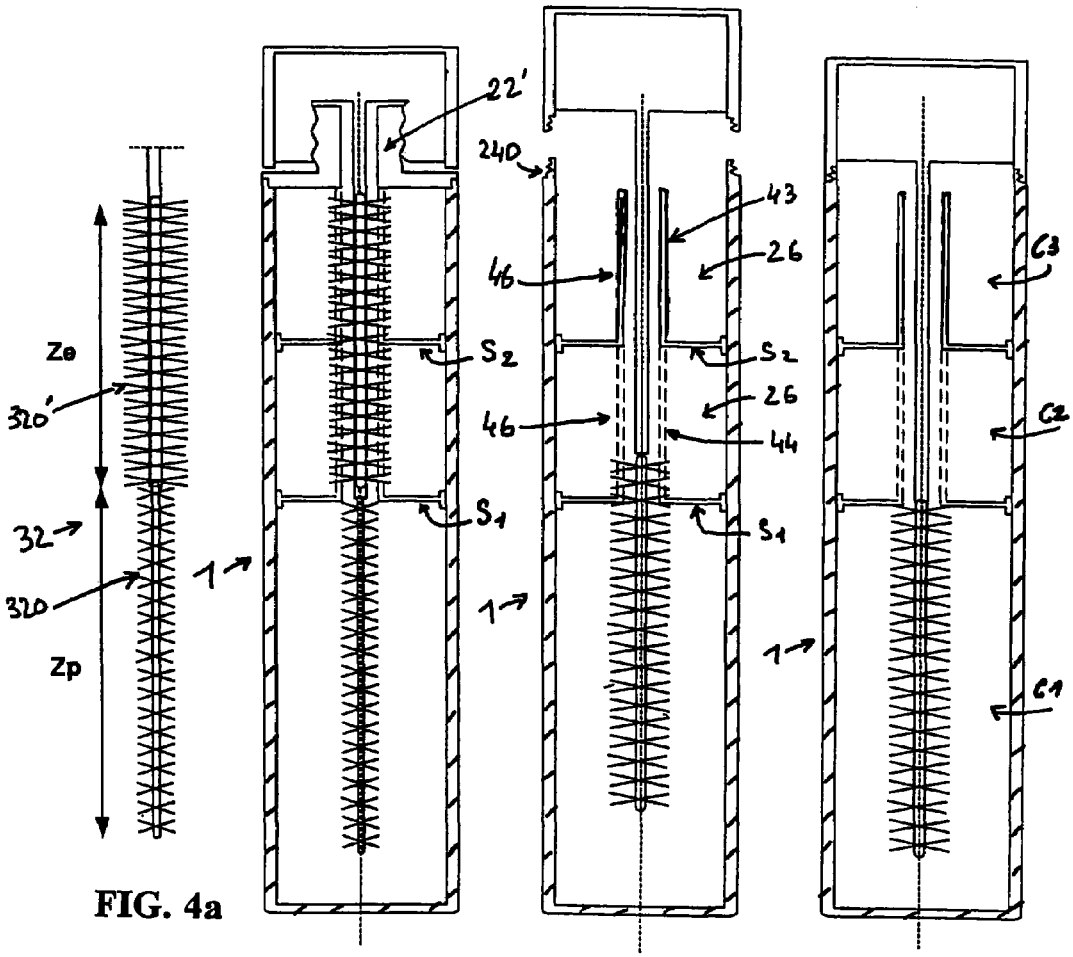
FIGS. 4*a* and 4*b* show a variant of the embodiment in FIGS. 3*a* and 3*b*. In this variant, the said body (2) comprises a sequence of three compartments (200) using two separation means (4) of the type of those shown in FIGS. 3*a* and 3*b*.

FIG. 4*a* represents the said application means (32).

Figure 3A:
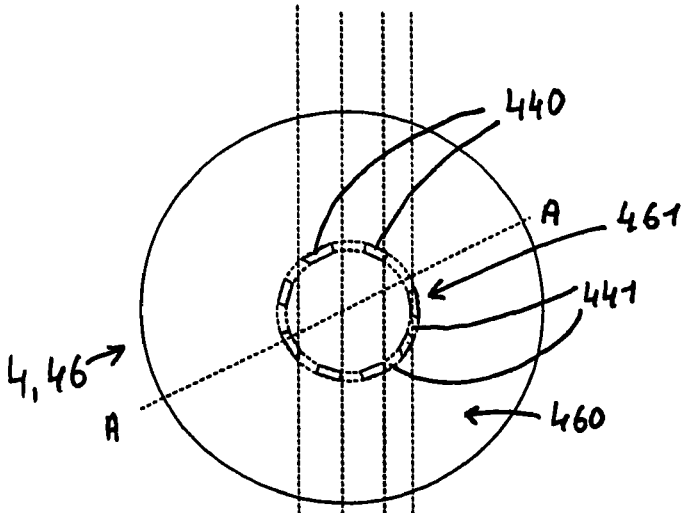
FIGS. 3*a* to 3*b* illustrate the embodiment of the separation means (4) shown in FIGS. 2*a* to 2*d*, in which the said add-on part (46) comprises a perforated tubular central part (44) comprising a sequence of axial rods (440) separated by axial spaces (441).
Figure 3B:
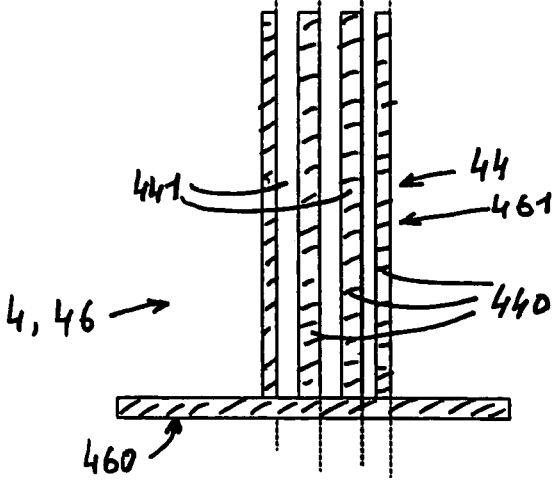

FIG. 4*b* represents the said distributor-applicator with three compartments (200), the two top compartments being formed using separation means (4) of the type shown in FIGS. 3*a* and 3*b*.

Figures 2A, 2B, 2C, 2D, 2E:
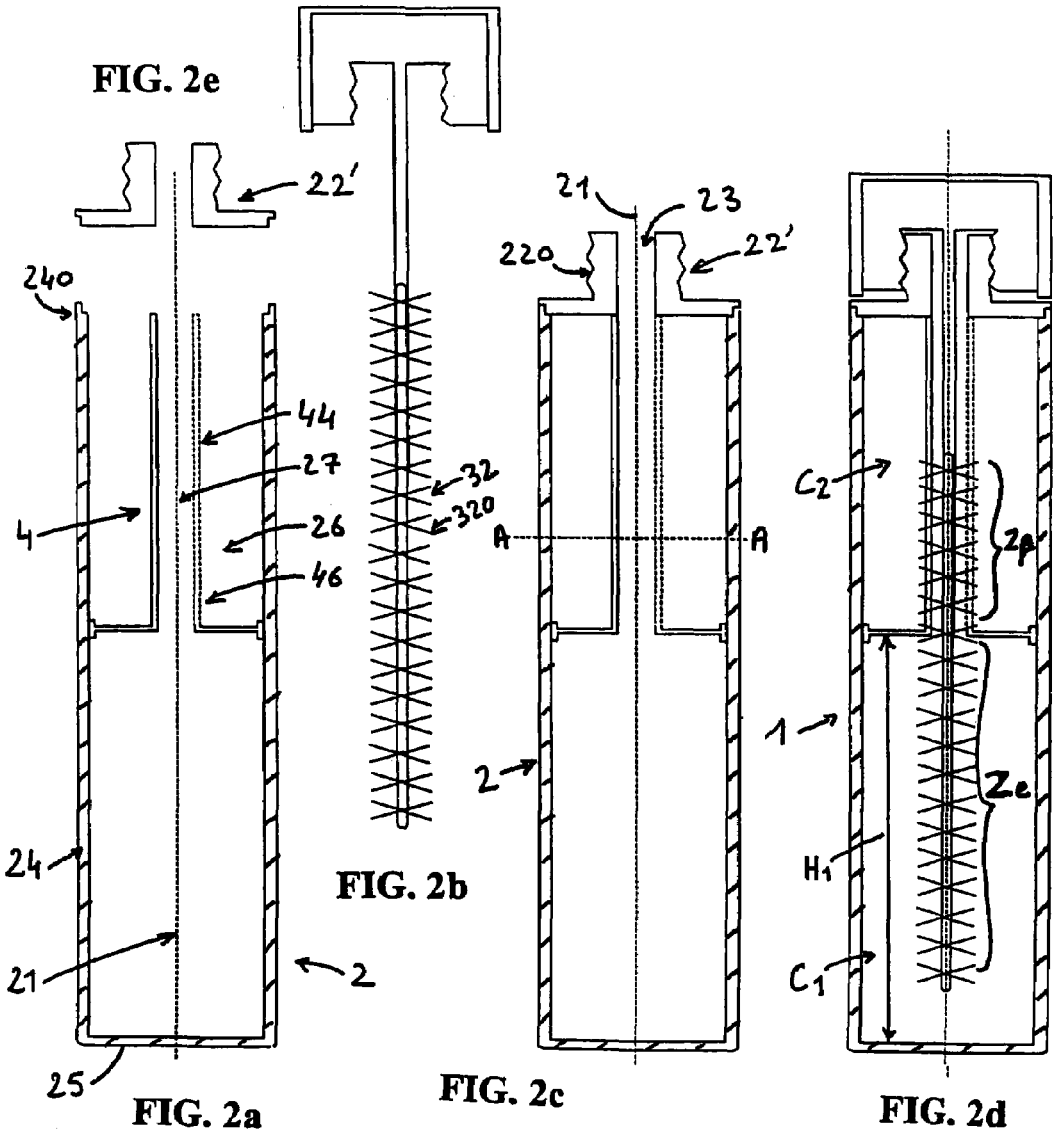
FIGS. 2*a* to 2*e* show another embodiment of the invention, also with two compartments (200) in which the said separation means (4) forms a part separate from the said body (2), an add-on part (46) that comprises a radial part (460) and a tubular part (461) in which the said body (2) comprises a removable head (22') so as to be able to insert the said add-on part into the said body, and in which the said application means comprises a brush with height>$H_1$.

FIGS. 4*c* and 4*d* show a variant of FIG. 4*b* in which firstly the two separation means (4) are separate, the upper separation means being similar to the separation means in FIGS. 2*a* and 2*c*, while the intermediate separation means are similar to the means in FIGS. 3*a* and 3*b*, and in which secondly the said body (2) does not include a head (22), the said skirt (24) having a typically threaded upper end (240) cooperating with the said cap (30) of the applicator (3).

FIG. 4*c* shows the said distributor-applicator (1) in a half open position with the said applicator (3) partially separated from the said body (2), while FIG. 4*d* shows the said applicator-distributor (1) closed.

FIGS. 5*a* to 5*g* show a variant of FIGS. 2*a* to 2*e* in which the said separation means (4) is formed by a radial projection (41) and in which the said product (5) is a solid product (51) forming an annular body (510) with a central opening (511).

FIG. 5*a*, similar to FIG. 2*a*, represents the said body (2) provided with the said extended radial projection (42) forming a central orifice (40) before assembly of the said removable head (22').

FIG. 5*b* shows the said body (2) after the said solid product (51) has been added, shown in section in FIG. 5*e* and in perspective in FIG. 5*f*.

FIG. 5*c* shows the said body (2) after the said solid product (51) has been inserted and after assembly of the said removable head (22').

FIG. 5*d* shows the corresponding said distributor-applicator (1) closed.

FIG. 5*h* shows a variant of the removable head (22') in FIGS. 5*c* and 5*d*, in which the said head comprises a means of wiping the said brush (320).

Figure 6A:
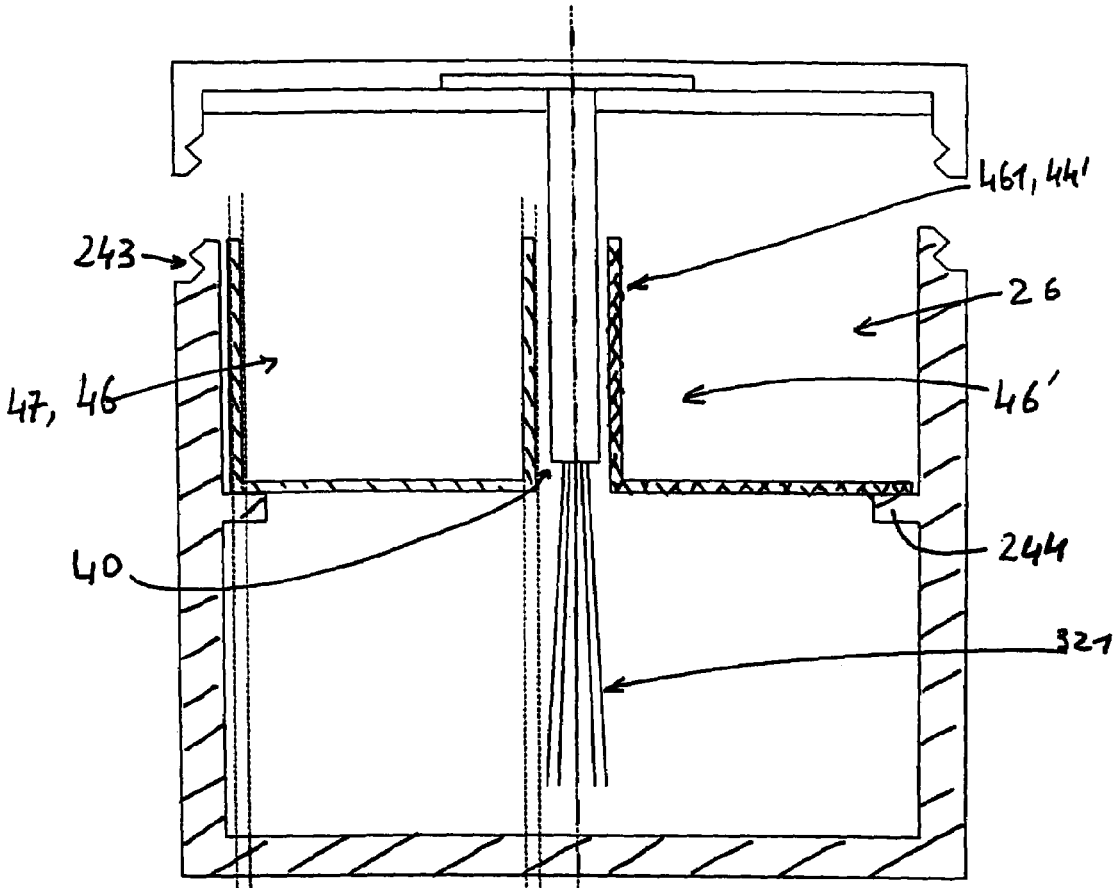
Figure 6B:
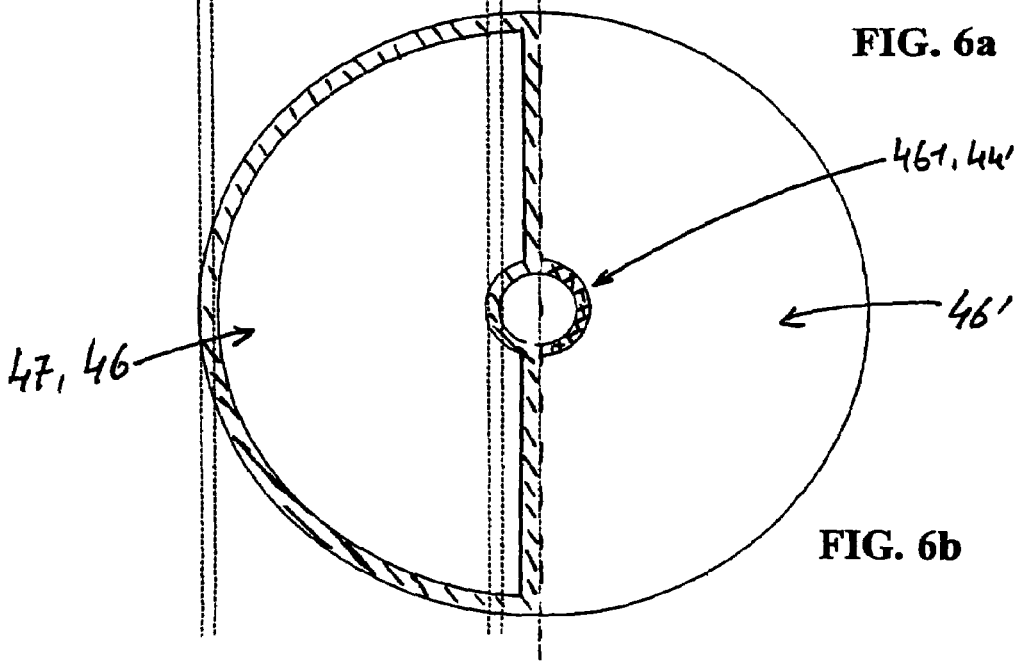

FIGS. 6*a* and 6*b* show two separate embodiments of separation means (4), in the case in which the said body comprises a narrow support rim (244) that fixes the said separation means formed by a "U"-shaped add-on part (46) forming a dish (47) on the left part of FIGS. 6*a* and 6*b*, or an "L"-shaped add-on part (46) as shown on the right part of FIGS. 6*a* and 6*b*, in the axial direction.

FIG. 6*a* shows an axial sectional view of the distributor-applicator (1) with the said applicator (2) partially offset from the said body (2) in the axial direction, the said application means (32) comprising a brush (321).

FIG. 6*b* shows a top view of the two embodiments of the add-on part (46, 46').

Figure 7A:
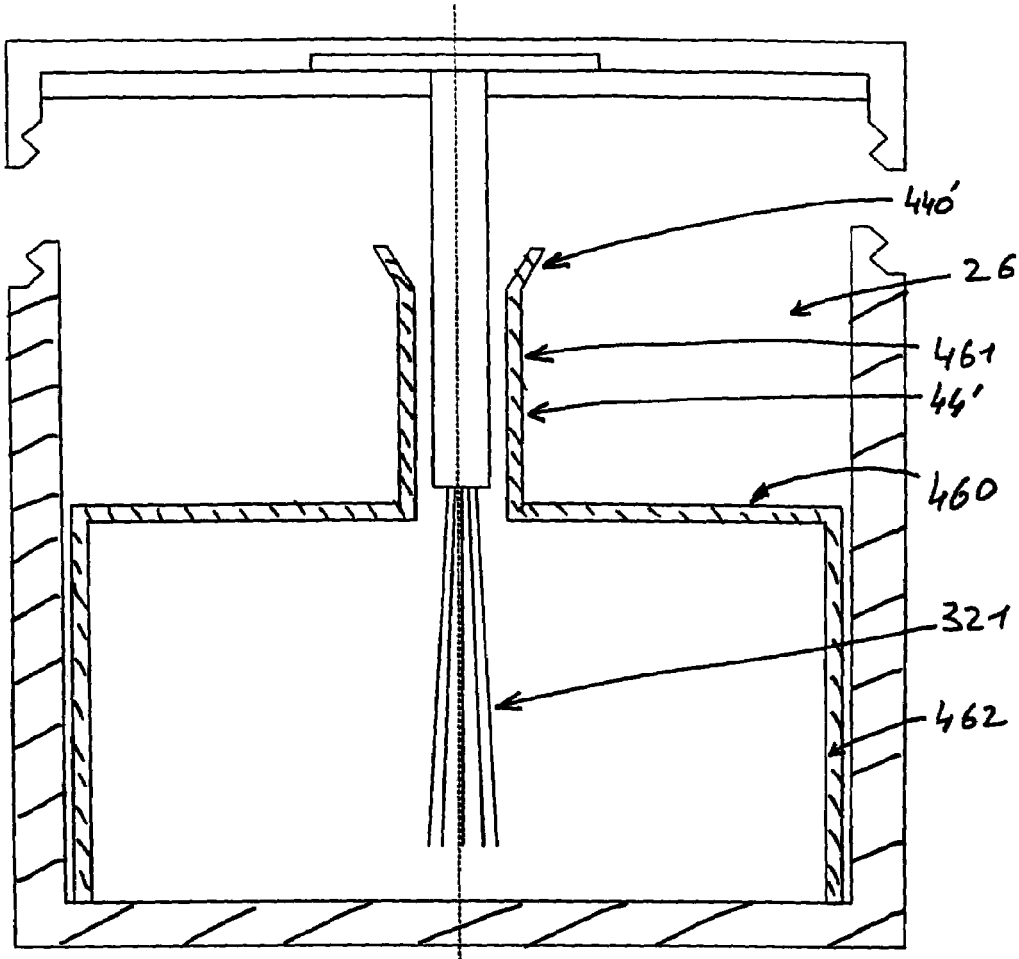
Figure 7B:
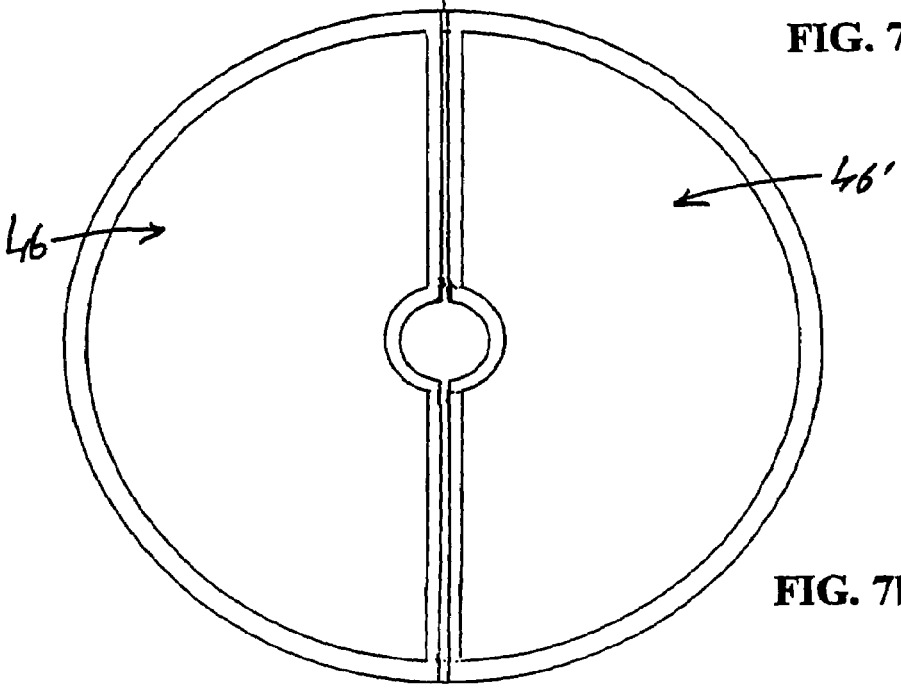

FIGS. 7*a* and 7*b* are similar to FIGS. 6*a* and 6*b* and show variants of distributors according to FIGS. 7*a* and 7*b*. They are different in that the said body does not include a radial projection (41), and in that the said separation means comprises a lower tubular part (462) for axial assembly of the said separation means (4) to the said body (2), and an upper tubular part (461) connected to a radial part (460), forming a reservoir for the said product $P_2$.

FIG. 7*a* is an axial sectional view of a variant in which the said separation means (4) consists of a single add-on part (46).

FIG. 7*b* is a top view of the said separation means formed by two identical add-on parts (46, 46') that are symmetric about a plane, these two parts (46, 46') forming two separate containers or reservoirs for two products $P_2$ and $P_2'$.

Figure 8:
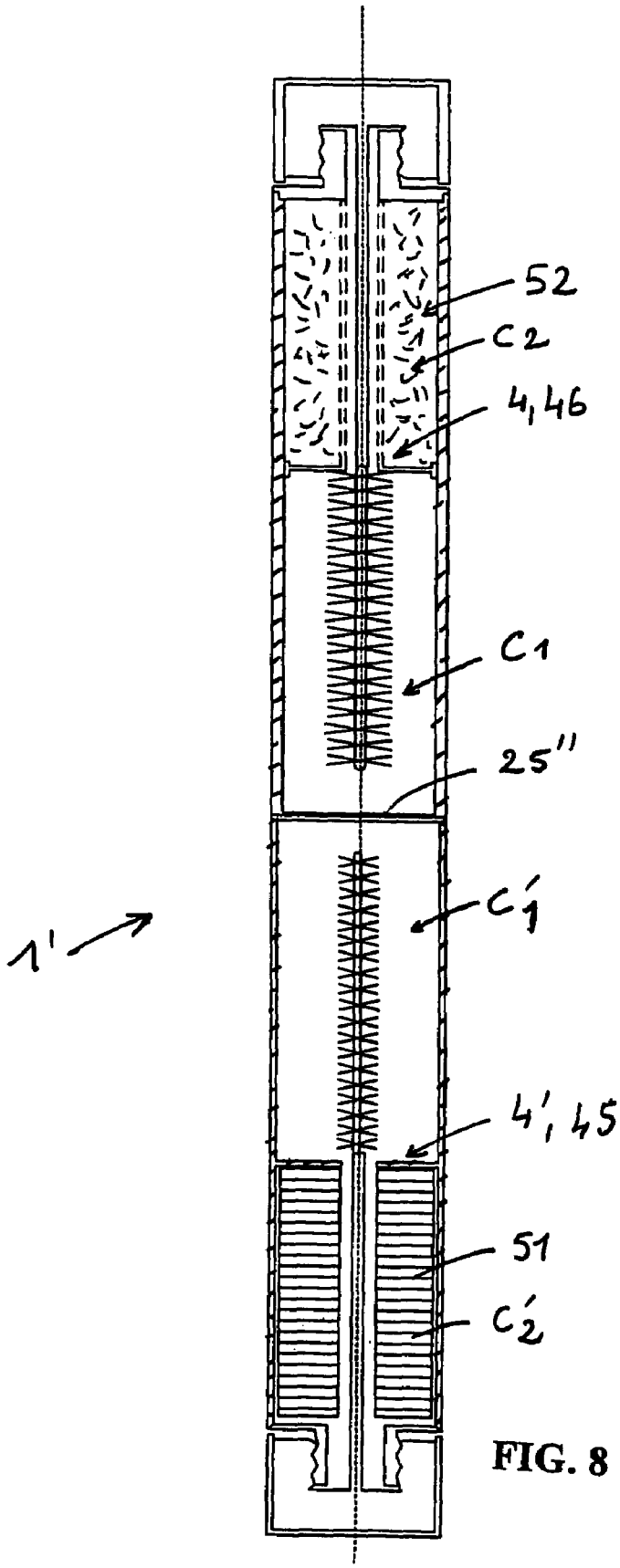

FIG. 8 shows another embodiment of the invention, in which the said body comprises two symmetric cavities on each side of the bottom (25), each cavity comprises two compartments (200), the top compartment comprising a separation means (4) of the type shown in FIG. 2*c* or 3*b*, while the lower cavity comprises a separation means (4') similar to that shown in FIG. 5*a* or 5*b*.

FIGS. 9*a* to 9*d* show another embodiment of the invention similar to that shown in FIG. 7*a*.

Figure 9A:
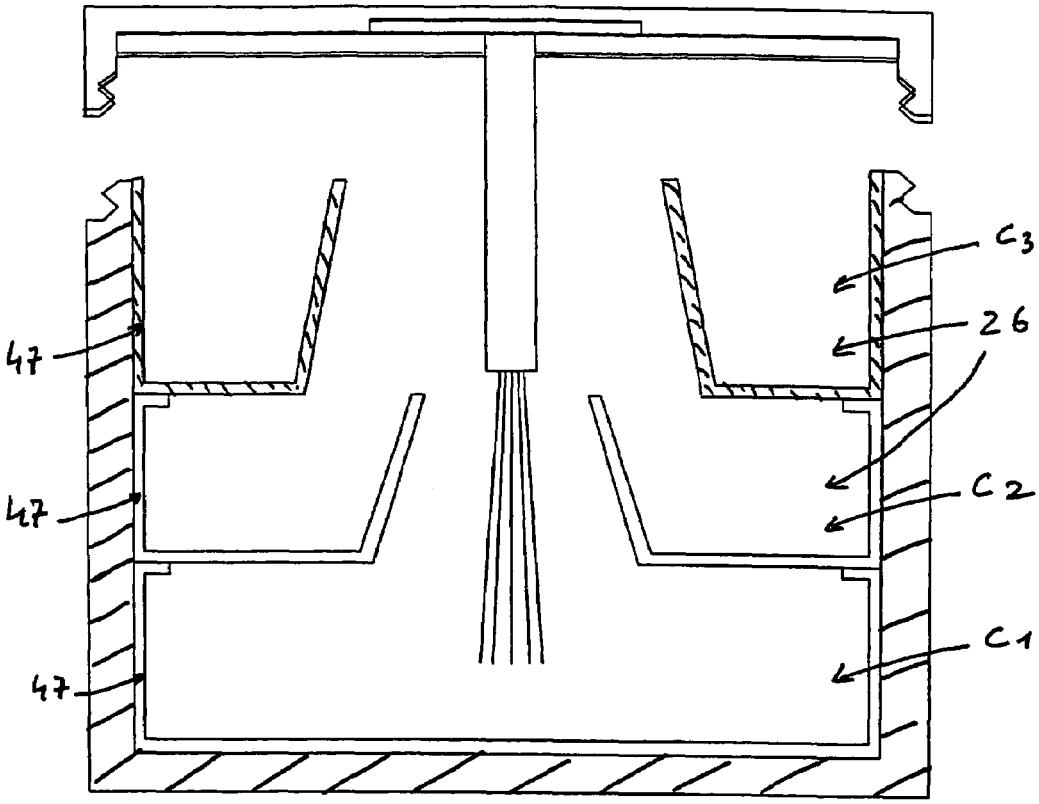
Figure 9B:
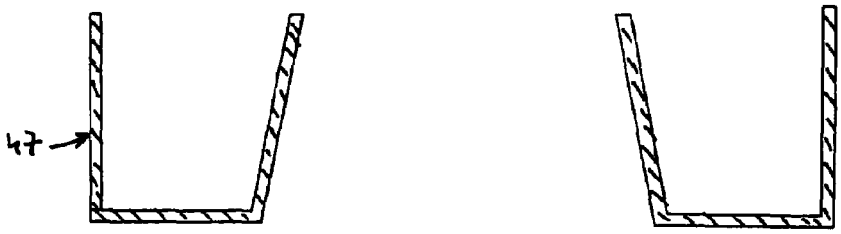
Figure 9C:
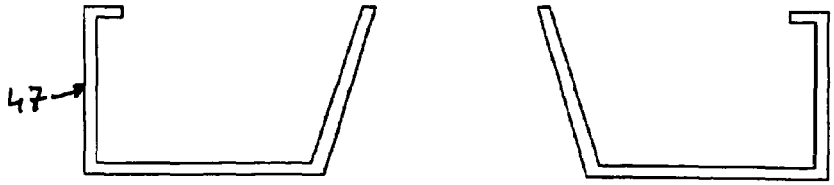
Figure 9D:
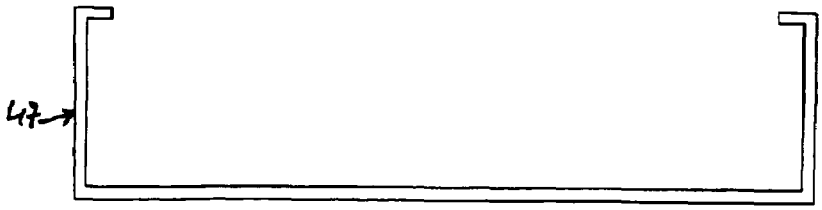

FIG. 9*a* is similar to FIG. 7*a* and differs from it in that the said body (2) comprises three compartments (200) formed by a stack of dishes (47).

FIGS. 9*a* to 9*d* each show the three dishes (47) in FIG. 9*a*.

Figure 10A:
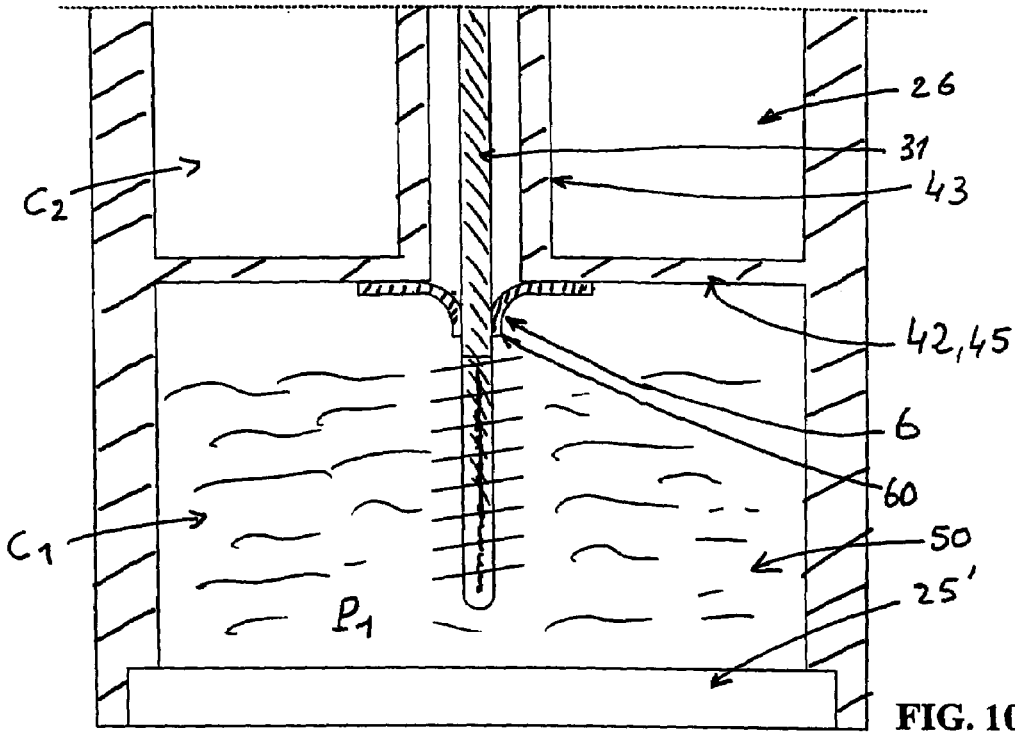
Figure 10B:
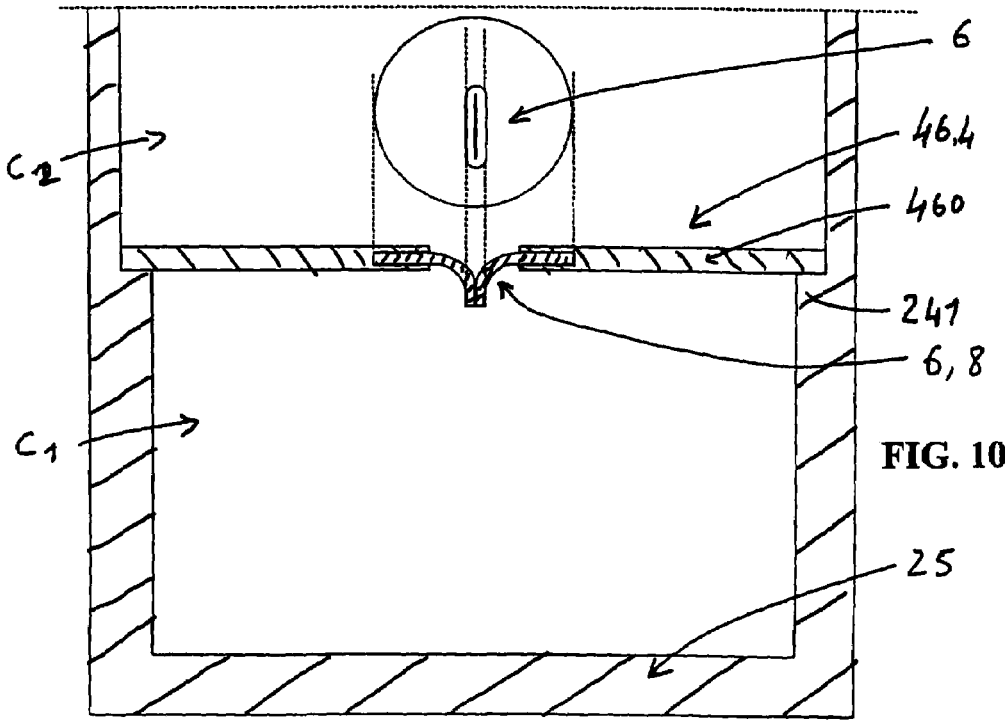

FIGS. 10*a* and 10*b* are partial axial sectional views representing other embodiments of the invention, in which the said lower compartment $C_1$ is closed off by a valve (6) and in which the said head, not shown in the figures, is a removable head (22').

On the embodiment shown in FIG. 10*a*, the said body (2) has a moving or removable bottom (25), the said separation means (4) forming a single-piece part with the said skirt (24) comprising an extended radial projection (42) and a vertical projection (43).

The valve (6) was assembled to the radial projection (42), typically by gluing. It cooperates with the rod (31) of the applicator (3) in a sealed manner.

On the embodiment shown in FIG. 10*b*, the skirt (24) comprises a lower shoulder (241) assembling the separation means (4) formed by an add-on part (46) forming a radial part (460).

In FIG. 10*b*, the valve (6), that was also shown as a bottom view, was fixed to the central orifice (40) of the extended radial projection (42).

Figure 11A:
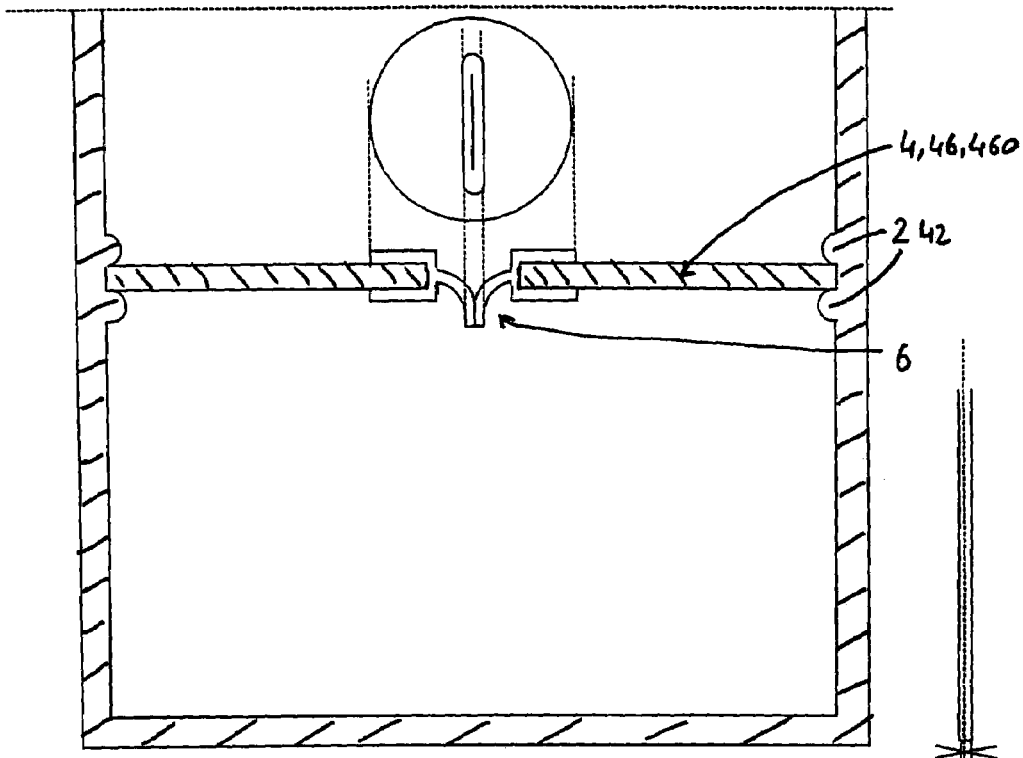

FIG. 11*a* corresponds to FIG. 10*b*, and differs from it by a variant for assembling the said valve (6) to the radial projection (42), and by cooperation of the separation means (4) forming an add-on part (46) that comprises only a radial part (460) with the skirt (24) provided with two click-fit ribs (242).

Figure 11C:
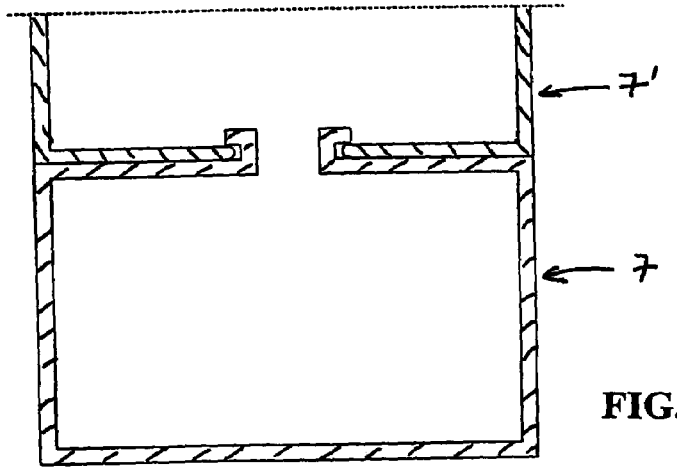
Figure 11B:
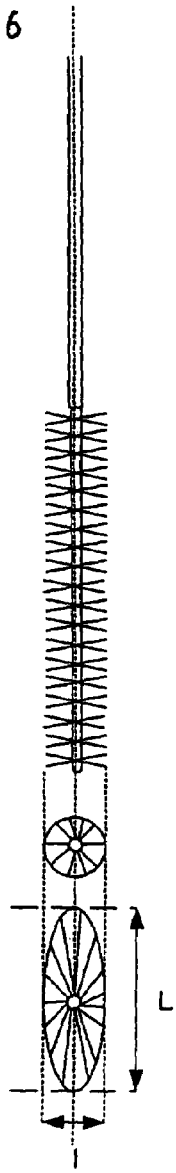

FIG. 11*b* shows an application means (32) with a brush (320) shown in an axial section and a cross-section, the section of the said brush being round or oval.

FIG. 11*c* is a partial view of the said body (2) with its separation means (4) formed by cooperation of two modular body portions (7) and (7') typically click-fitted together, the said portion of the lower body (7) forming the bottom (25) and the said portion of the top body (7') forming the said opening (32)—not shown in the figure.

DETAILED DESCRIPTION OF THE INVENTION

According to the invention, and particularly as illustrated in FIG. $\mathbf{1}_c$, the said cavity (20) of the said body (2) may comprise two successive compartments (200), a lower compartment $C_1$ with height $H_1$ containing the product $P_1$, the said product $P_1$ being a fluid product, and a top compartment $C_2$ with height $H_2$ containing the product $P_2$, the said lower compartment being contiguous with the said bottom at its lower part, the top of the said upper compartment $C_2$ being contiguous with the said rim (243) or the said neck (220).

According to one embodiment of the invention illustrated for example in FIGS. 1*a*, 2*a*, 4*b* and 5*a*, the said separation means $S_i$ (4, 4') may typically comprise a central orifice $O_i$ (40) forming the said communication means between the compartments $C_i$ and $C_{i+1}$ and forming an axial passage for the said application means (32), the said separation means $S_i$ (4, 4') delimiting the said compartment $C_i$ near the top and thus forming a partition between the said compartments $C_i$ and $C_{i+1}$ of the said cavity (20).

The said separation means $S_i$ (4, 4') of the compartment $C_i$ may form a support for the product(s) $P_{i+1}$ contained in the adjacent compartment $C_{i+1}$ and located axially above compartment $C_i$.

With this purpose, the said separation means $S_i$ (4, 4') of the compartment $C_i$ may comprise a projection or a typically radial part (41, 42, 460).

Typically, the said projection or radial part (41, 42, 460) may form an extended radial projection (42) sufficiently large so that the said typically central orifice $O_i$ (40) may be filled in or closed off by the said application means (32).

Figure 1D:
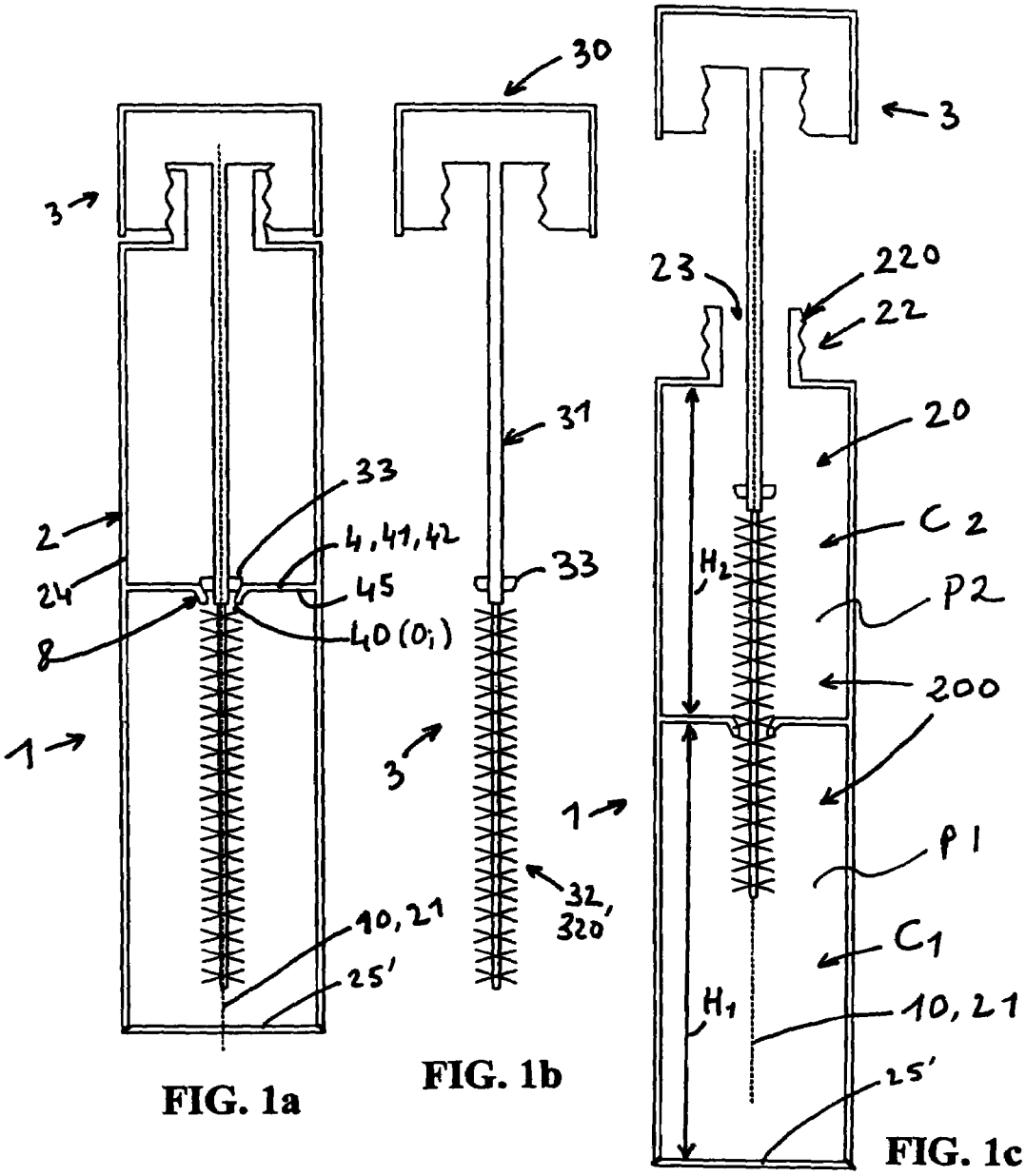
FIG. 1*d* shows a partial view of a variant of the said radial projection in which the said central orifice comprises a wiping insert.
Figure 1D:
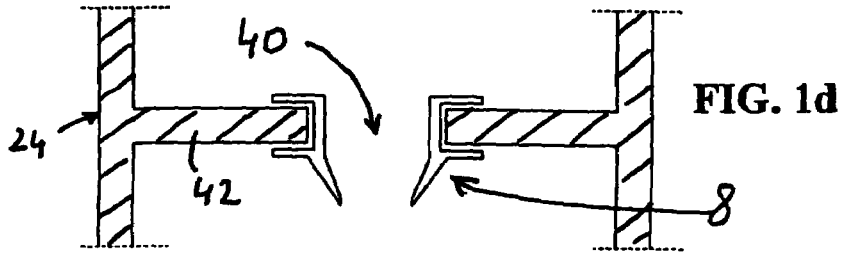

Thus, for example the central orifice (40) is filled in in FIG. 1*a*, while it is closed off in FIG. 6*a*. A more or less leak tight cooperation between the said application means and the said orifice (40) will be necessary, depending on the viscosity of the products $P_1$ in particular, and $P_i$ in general.

As illustrated in FIGS. 2*a*, 3*b*, 4*c*, 6*a*, 7*a*, 9*a*, 10*a*, the said means of separation $S_i$ (4, 4') of compartment $C_i$ may comprise a part forming a radial projection (41) and a part forming a vertical or inclined projection (43), so as to form firstly a secondary cavity (26) typically capable of containing a fluid product, and secondly the said complementary or free volume (27) forming the said communication means.

As illustrated in these same figures, the said separation means $S_i$ (4, 4') for i=1 can include a top central duct (44'), typically provided with a flared top part (440')—see FIG. 7*a*, and/or a bottom part through which the said application means can pass, the said top central duct (44') delimiting the inside of the said complementary or free volume (27) forming the said communication means.

In this case, the said duct is coincident with the said vertical projection mentioned above.

As illustrated in FIGS. 2*a* to 3*b*, and in FIG. 4*c* (see separation means $S_1$), the said vertical projection or the said duct may comprise or may form a perforated tubular central part (44), so as to form the said secondary cavity (26) that will typically contain the said product $P_2$, and such that the said application means (32) can collect the said product $P_2$ particularly during translation of the said application means within the said complementary or free volume (27).

In this case, the said central open tubular part (44) may typically comprise several axial rods (440) forming axial spaces (441) between them through which the said rows of bristles of the said brush (320, 320') are free to pass and so as to collect the said product $P_2$. But it is possible that this open tubular central part forms a type of grid or equivalent means capable of typically containing the said product $P_2$ in the said secondary cavity (26), while enabling collection of the said product particularly during translation of the application means within the said complementary or free volume (27).

According to one variant of the invention, the said orifice $O_i$ (40) for i=1 may comprise or form a non-return valve or flap (6), the said valve or the said flap (6) being open typically when the said applicator (3) cooperates with the said body, the said application means then typically being in contact with the said product $P_i$ for i=1, and closed when the said applicator (3) is separated from the said body (2).

Thus, as illustrated in FIGS. 10*a* and 10*b*, the said separation means $S_i$ (4, 4') for i=1 may form or include an elastic membrane comprising rims or adjacent lips (60) delimiting the said orifice $O_i$ for i=1, like a valve, the said lips (60) being capable of elastically and reversibly separating during the said axial displacement of the said applicator (3) so as to enable the said application means (32) to pass through the said orifice (40) so as to prevent or limit mixing of the said products (5) in two different compartments (200).

According to one embodiment of the invention illustrated in FIGS. 1*a*, 5*a*, 10*a* and 11*b*, the said separation means $S_{i-1}$ (4, 4') may form or comprise a single-piece part (45) with the said body (2).

According to another embodiment of the invention illustrated in FIGS. 2*a*, 4*b*, 6*a*, 9*a*, 10*b* and 11*a*, the separation means may form or comprise an add-on part (46, 46') in the said cavity (20), typically fixed to the said body (2) by assembly or by click-fitting.

However, as shown in FIGS. 6*a* or 11*a*, the said separation means (4) may comprise cooperation of elements (242, 244) forming a single block with the said body (2) with an add-on part (46, 46') in order to assemble and block the said add-on part in the said body.

As illustrated in FIGS. 1*a*, 5*h*, 10*b* and 11*a*, the said neck (220) and/or the said orifice $O_i$ (40), typically for i=1, may comprise or form a wiping means (8) of the said application means (32), so as to remove the excess amount of at least the said product $P_i$, typically the fluid product $P_1$.

In the case in FIGS. 10*a* to 11*a*, the said wiping means may also consist of a valve (6) with adjacent lips (60).

According to the invention, the said application means (32), typically a brush (320, 320'), may have a circular section, the said section being taken in a plane perpendicular to the said axial direction (10, 21) such that the said applicator (3) does not need to be oriented with respect to the said body (2) during the said translation.

However, cases arise in which the said application means (3) may have a non-circular section S, and a shape factor L/l equal to at least 2, where L and l are the largest and the smallest dimensions respectively, the said section being taken in a plane perpendicular to the said axial direction (10, 21) such that all or part of the said translation requires relative orientation of the said applicator (3) with respect to the said body (2).

FIG. 11*b* diagrammatically shows the two types of brushes, with round and oval sections. Advantageously, the said section S of the said application means (3) and the said orifice $O_i$ (40) of the said separation means (4, 4') may be geometrically similar.

In general, the said applicator (3) may comprise a single application means A (32), the said rod (31) being sufficiently long so that the said application means (32) is in contact with the said product $P_1$ contained in compartment $C_1$ particularly when the said cap (30) closes off the said opening (23) of the said body (2).

In this case, as illustrated particularly in FIGS. 1*a* to 1*c*, the said application means A (32) may have a height typically equal to approximately $H_1$, and can fill in or close off the said orifice $O_1$.

The applicator (3) shown in FIGS. 1*a* to 1*c* comprises a sealing means (33) cooperating with the said central orifice (40) of the separation means (4) such that the said compartment $C_i$ is closed off typically in a sealed manner when the said distributor-applicator is closed.

However, as illustrated in FIGS. 2*b* and 2*d*, the said applicator (32) may comprise a single application means A, with a height typically greater than $H_1$, so that it can come into contact with the said product $P_1$ contained in the compartment $C_1$ and with the said product $P_2$ contained in the compartment $C_2$ when the said cap closes off the said body, so as to have a zone Ze called the remote zone on the application means after the said separation, including collected amounts of products $P_1$ and $P_2$, and a zone Zp called the near zone containing only collected products $P_2$.

Figure 3C:
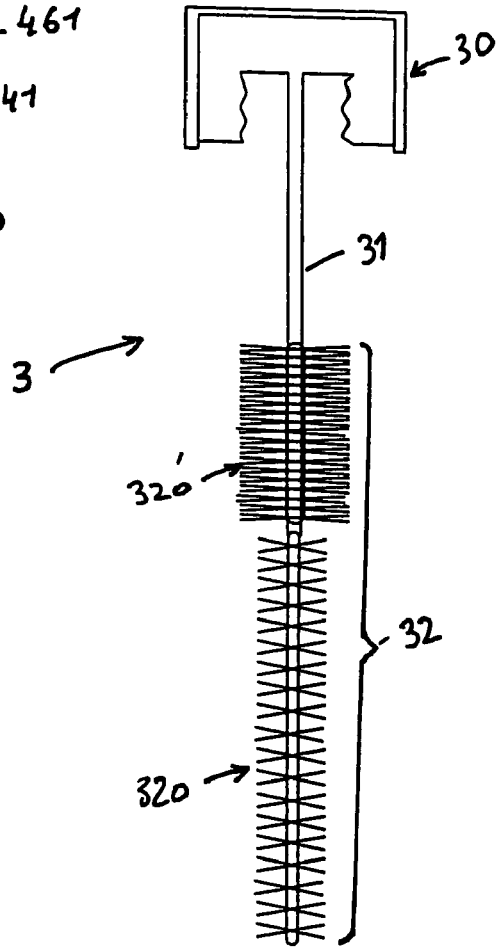
FIG. 3*c* corresponds to FIG. 2*b*, and shows an applicator (3) provided with two different diameter brushes (320, 320'), the bristles of the large diameter brush being designed to pass between the axial rods (440).

As illustrated in FIG. 3*c* or FIG. 4*a*, the said applicator may comprise at least two application means $A_i$ (32), typically two separate brushes (320, 320') mounted in series on the said rod (31) and possibly as many application means $A_i$ as there are separate compartments $A_1$ and $A_2$ and typically two separate application means $A_1$ and $A_2$, the said application means $A_1$ being in contact with the said product $P_1$ contained in compartment $C_1$ when the said cap (30) closes off the opening (23) of the said body (2), and the said application means $A_2$ being in contact with the said product $P_2$ contained in the compartment $C_2$ when the said cap closes off the opening (23) of the said body (2).

As illustrated in FIG. 4*b*, the said separate application means $A_i$ (32) may have an increased section in the direction from $A_i$ to $A_{i+1}$, such that each application means $A_i$ only collects the product(s) $P_i$ contained in the corresponding said compartment $C_i$.

Figure 3D:
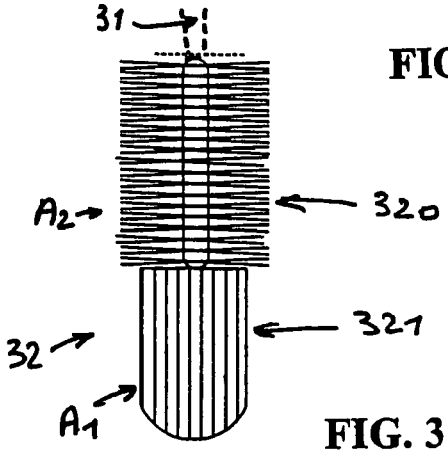
FIG. 3*d* shows another application means (32) comprising a brush (320) and a complementary means other than a brush (321) typically formed from an absorbent material. According to the axial configuration shown in FIG. 3*d*, the said brush (320) forms the application means $A_2$, while the complementary means forms the application means $A_1$.

As illustrated in FIG. 3*d*, the said applicator (3) may comprise two axially separate application means $A_1$ and $A_2$, one forming a brush (320) based on bristles, and the other (321) not forming a brush and comprising a material, typically divided or cellular, capable of collecting a solid or a liquid.

In FIG. 3*d*, the brush (320) forms the application means $A_2$ while the other application means not including the brush (321) and formed from an absorbent material forms the means $A_1$ located above means $A_2$ according to the convention used by which the smallest subscript corresponds to the axial position furthest from the said cap (30) or closest to the said bottom (25).

However, the invention includes the opposite arrangement in which the brush (320) forms the application means $A_1$ and the absorbent material forms the application means $A_2$.

According to the invention, and as illustrated as an example in FIGS. 1*a*, 10*a* and 10*b*, the said rod (31), or possibly the said application means (32), cooperates with the said separation means (4, 4'), possibly due to a means (33) fixed to the said rod (3) or due to a means (6) fixed to the said separation means (4, 4') designed to close off the said orifice (40) in order to make at least one compartment (200) and typically the said compartment $C_1$ leak tight, when the said cap (30) closes off the opening (23) of the said body (2).

Considering the structure of distributors-applicators (1) according to the invention, the said head (22) and/or the said bottom (25) of the said body (2) may form removable parts (22', 25') so that the said separation means $S_i$ (4, 4') and/or the said products $P_i$ can enter into the said cavity (20). A removable part means a separate part assembled to the skirt (24) of the body (2), these parts possibly being assembled reversibly, or more typically irreversibly.

A distributor-applicator (1) with a removable head (22') is shown in FIGS. 2*a* to 2*d*, 4*b*, 5*b*. A distributor-applicator (1) with a removable bottom (25') is shown in FIGS. 1*a*, 1*c* and 10*a*.

According to another embodiment of the invention illustrated in FIG. 11*c*, the said body (2) and the said separation means are formed by axial assembly, typically by click-fitting or by gluing or heat sealing, of at least two modular body portions (7) and (7'), one comprising the said bottom (25) and the other comprising the said opening (23).

This method may be advantageous as an alternative to make distributors-applicators (1) according to the invention, particularly in the case of more complex shapes.

According to the invention, all or some of the said body (2) may be formed by a typically transparent moulded plastic material.

Another purpose of the invention consists of using the distributor-applicator (1) according to the invention for packaging several cosmetics $P_i$, at least one of the products $P_i$ being a fluid product.

Preferably, the said fluid product may be a make-up product, and typically a mascara.

The said fluid product can usually be packaged in the said compartment (200) $C_1$.

The said products $P_i$ (5), typically for i>1, may comprise typically agglomerated solid products (51), the said solid products (51) typically forming annular or toroidal bodies (510), comprising a central opening (511), allowing passage of the said application means (32).

The said products $P_i$ (5), typically for i>1, may also typically comprise unagglomerated solid products (52), the said solid products (52) typically forming particles or a powder with a high flow angle or coefficient.

The said products $P_i$ (5), typically for i>1, may also be fluid products (50), typically in the form of a liquid, paste or powder possibly with a low flow angle or coefficient.

According to the invention, the said lower compartment $C_1$ of the distributor-applicator may be designed to contain a fluid product $P_1$, typically a mascara, while the said upper compartment $C_2$ may be designed to contain a solid product $P_2$, typically in the form of a powder of spangles, so as to increase the quantity of solid material on the said application means, typically when the said product $P_1$ is a mascara.

EXAMPLE EMBODIMENTS

FIGS. 1*a* to 11*c* form example embodiments.

The said body (2) and the said separation means (4, 4') were formed by moulding a thermoplastic material.

The applicators (3) were formed in the usual manner, the said cap (30) and the said rod (31) being made of plastic, the application means (32) itself being formed in a normal manner, the brushes (320, 320') being formed by a cooperation of rows of bristles with a twisted metallic wire.

The distributor-applicator (1) according to FIGS. 1*a* to 1*c* corresponds to applications in which the product $P_1$ (typically a mascara) placed in the lower compartment $C_1$ and the product $P_2$ placed in the upper compartment $C_2$ may possibly partially mix together without any disadvantages.

The distributor-applicator (1) according to FIGS. 2*a* to 3*b* corresponds to the case in which the product $P_1$ (typically a mascara) placed in the lower compartment $C_1$ and the product $P_2$ placed in the upper compartment $C_2$ do not mix together, however the product $P_2$ being collected by the brush (320) using the open central tubular part (44) of the said separation means. For example, the product $P_2$ may be composed of a powder of spangles, such that the brush covered with mascara as it comes out of the compartment $C_1$, picks up spangles at the surface of the brush as it passes through the compartment $C_2$.

The distributor-applicator (1) according to FIGS. 4*b* to 4*d* comprises three compartments, compartments $C_1$ and $C_2$ corresponding to those shown in FIGS. 2*a* to 3*b* and the upper compartment $C_3$ being accessed directly once the cap (30) of the applicator (3) is removed.

For example, a creamy, typically non-fluid product, could be kept in such a compartment.

The distributor-applicator (1) according to FIGS. 5*a* to 5*d* corresponds to the case in which the said product $P_2$ contained in compartment $C_2$ forms a solid block with a central duct such that as it is translated, the surface of the brush (320) containing product $P_1$ can also collect product $P_2$ as the block comes into contact with the product $P_2$. It is also possible that the product $P_2$ actually forms several stacks of blocks, so as to have several grades of solid products ($P_2$, $P_2'$, etc.), if required.

The distributors-applicators (1) in FIGS. 6*a* to 7*b* correspond to cases in which the compartment $C_2$ is accessed directly from the outside, the product $P_2$ typically being non-fluid (powder block, cream, etc.) and in which the said application means forms a brush, the product $P_1$ contained in product $C_1$ being a fluid product.

The distributor-applicator (1) according to FIG. 8 is of the "duo" type (1') and corresponds approximately to two applicators-distributors (1) assembled through a common bottom (25").

The distributor-applicator (1) according to FIGS. 9*a* to 9*d* comprises three compartments formed by a stack of add-on parts forming a receptacle (47), each compartment $C_1$ possibly containing the corresponding typically non-fluid product $P_i$.

Distributors-applicators (1) according to FIGS. 10*a* to 11*c* comprise a compartment $C_1$ provided with a sealing valve such that this type of distributor-applicator (1) is particularly suitable for packaging possibly very fluid products $P_1$.

ADVANTAGES OF THE INVENTION

As is clear from the above, distributors-applicators (1) according to the invention considerably modify and broaden the possibilities of traditional distributors-applicators.

Firstly, distributors-applicators according to the invention are adapted to simultaneous packaging of all sorts of products with completely different rheological properties, from very fluid liquids to solids, and including paste or non-fluid creamy products, or by powders or spangles, all in the same packaging.

Moreover, in many cases distributors-applicators (1) according to the invention can obtain two different products on the application means (32) with a single gesture, in order to obtain a special make-up effect.

Finally, distributors-applicators (1) according to the invention open up an opportunity for a large number of new combinations, so that new needs can be satisfied simply by adapting the information divulged in this invention.

LIST OF MARKS

Distributor-applicator . . . 1
"Duo" distributor-applicator . . . 1'
Axial direction parallel to 21 . . . 10
Body . . . 2
Cavity . . . 20
  Compartments of 20 . . . 200
Axial direction parallel to 10 . . . 21
Head . . . 22
  Threaded neck . . . 220
Removable head . . . 22'
Opening . . . 23
Lateral skirt . . . 24
  Top end . . . 240
  Bottom shoulder . . . 241
  Click-fit ribs (grooves) . . . 242
  Rim (threaded) . . . 243
  Support rim . . . 244
Bottom . . . 25
Removable bottom . . . 25'
Common bottom . . . 25"
Secondary cavity . . . 26
Complementary or free volume . . . 27
Applicator . . . 3
Cap . . . 30
Rod . . . 31
Application means . . . 32
  Brush (side bristles) . . . 320, 320'
  Brush (end bristles) . . . 321
Means of making 200 leak tight . . . 33
Separation means . . . 4, 4'
Central orifice . . . 40
Radial projection . . . 41
Extended radial projection . . . 42
Inclined or vertical projection . . . 43
Perforated tubular central part . . . 44

Axial rods . . . 440
Axial spaces . . . 441
Central duct . . . 44'
Flared upper part . . . 440'
Single-piece part with 2 . . . 45
Add-on part . . . 46, 46'
Radial part . . . 460
Tubular part . . . 461
Lower tubular part . . . 462
Add-on part forming a receptacle . . . 47
Product . . . 5
Liquid or fluid product . . . 50
Solid product (agglomerated) . . . 51
Annular body . . . 510
Central opening . . . 511
Non-agglomerated solid products . . . 52
Valve . . . 6
Elastic lips . . . 60
Modular body portion . . . 7, 7'
Means of wiping 32 . . . 8

The invention claimed is:

1. Distributor-applicator (1) mobile in the axial direction (10) designed to contain a cosmetic (5), comprising a body (2) forming a cylindrical and longitudinal cavity (20) with a height H along its axial direction (21) containing said cosmetic (5), and in which there is an opening, said body (2) being provided with a lateral skirt (24), fixed with a rim (243) or a head (22) at its top end containing a threaded neck (220) surrounding said opening (23), and forming a bottom (25) at its bottom end, and an applicator (3) comprising a threaded cap (30) forming a means of gripping said applicator (3) and intended to cooperate with said rim (243) or said neck (220) of said head (22), a rod or a longitudinal support (31) and an application means (32), comprising a brush (320) consisting of one or several rows of bristles, said rod (31) being fixed to said cap (30) at one of its ends, and fixed to said application means (32) at its other end, such that said application means (32), at the contact of said product (5) when said cap closes off said opening (23) of said body (2), collects some of said product (5) and after separation of said applicator (3) from said body (2), including an axial translation, enables application of said collected product on a support, and characterised in that:

a) said body (2) comprises an axial partition in said cavity (20) so as to form an axial sequence of N staged compartments (200) in said cavity (20), denoted $C_1$ to $C_N$, where N varies from 2 to 4, each compartment $C_i$ with height $H_i$ containing said cosmetic(s) $P_i$, said cosmetic(s) $P_i$ being different from said cosmetic(s) $P_{i+1}$ in compartment $C_{i+1}$ located above it, and said cosmetic $P_i$ being a fluid product, b) axial partition comprises N−1 separation means S (4, 4'), said separation means S (4, 4') being denoted $S_i$, where i is equal to not more than N−1, between two successive compartments $C_i$ and $C_{i+1}$, c) each compartment Ci, where i>1, comprising a volume forming a storage means for said product $P_i$, and also a complementary or free volume (27) forming a communication means, such that said application means (32) can access each of said compartments $C_i$, where i'<i, in order to collect said corresponding products $P_{i'}$, in which said separation means $S_i$ (4, 4') comprises a central orifice $O_i$ (40) forming said communication means between the compartments $C_i$ and $C_{i+1}$ and forming an axial passage for said application means (32), said separation means $S_i$ (4, 4') delimiting said compartment $C_i$ near the top and thus forming a partition between said compartments $C_i$ and $C_{i+1}$ of said cavity (20).

2. Distributor-applicator according to claim 1 in which said cavity (20) comprises two successive compartments (200), a lower compartment $C_1$ with height $H_1$ containing the product $P_1$, said product $P_1$ being a fluid product, and a top compartment $C_2$ with height $H_2$ containing the product $P_2$, said lower compartment being contiguous with said bottom at its lower part, the top of said upper compartment $C_2$ being contiguous with said rim (243) or said neck (220).

3. Distributor-applicator according to claim 1, in which said separation means $S_i$ (4, 4') of the compartment $C_i$ forms a support for product(s) $P_{i+1}$ contained in the adjacent compartment $C_{i+1}$ and located axially above compartment $C_i$.

4. Distributor-applicator according to claim 1 in which said separation means $S_i$ (4, 4') of compartment $C_i$ comprises a radial projection or part (41, 42, 460).

5. Distributor-applicator according to claim 4 in which said projection or radial part (41, 42, 460) forms a sufficiently large radial projection (42) so that said central orifice $O_i$ (40) may be filled in or closed off by said application means (32).

6. Distributor-applicator according to claim 1 in which said means of separation $S_i$ (4, 4') of compartment $C_i$ comprises a part forming a radial projection (41) and a part forming a vertical or inclined projection (43), so as to form firstly a secondary cavity (26) capable of containing a fluid product, and secondly said complementary or free volume (27) forming said communication means.

7. Distributor-applicator according to claim 6, in which said vertical projection or said duct comprises or forms a perforated tubular central part (44), so as to form said secondary cavity (26) that will contain said product $P_2$, and such that said application means (32) can collect said product $P_2$ particularly during translation of said application means in said complementary or free volume (27).

8. Distributor-applicator according to claim 7 in which said central open tubular part (44) comprises several axial rods (440) forming axial spaces (441) between them through which said rows of bristles of said brush (320, 320') are free to pass and so as to collect said product $P_2$.

9. Distributor-applicator according to claim 1, in which said separation means $S_i$ (4, 4') for i=1 include a top central duct (44'), provided with a flared top part (440') and/or a bottom part through which said application means can pass, said top central duct (44') delimiting the inside of said complementary or free volume (27) forming said communication means.

10. Distributor-applicator according to claim 1, in which said orifice $O_i$ (40) for i=1 comprises or forms a non-return valve or flap (6), said valve or said flap (6) being open when said applicator (3) cooperates with said body, said application means then being in contact with said product $P_i$ for i=1, and closed when said applicator (3) is separated from said body (2).

11. Distributor-applicator according to claim 1 in which said separation means $S_i$ (4, 4') for i=1 forms or includes an elastic membrane comprising adjacent rims or lips (60) delimiting said orifice $O_i$ for i=1, like a valve, said lips (60) being capable of elastically separating during said axial displacement of said applicator (3) so as to enable said application means (32) to pass through said orifice (40) so as to prevent or limit mixing of said products (5) in two different compartments (200).

12. Distributor-applicator according to claim 1, in which said separation means $S_1$ (4, 4') forms or comprises a single-piece part (45) with said body (2).

13. Distributor-applicator according to claim 1, in which said separation means $S_{i-1}$ (4, 4') forms or comprises an add-on part (46, 46') in said cavity (20), fixed to said body (2) by assembly or by click-fitting.

14. Distributor-applicator according to claim 1, in which said neck (220) and/or said orifice $O_i$ (40), for i=1, comprises or forms a means (8) of wiping said application means (32), so as to remove the excess amount of at least said product $P_i$, the fluid product $P_1$ for i=1.

15. Distributor-applicator according to claim 1, in which said application means (32), comprising a brush (320, 320'), has a circular section, said section being taken in a plane perpendicular to said axial direction (10, 21) such that said applicator (3) does not need to be oriented with respect to said body (2) during said translation.

16. Distributor-applicator according to claim 15, in which said section S of said application means (3) and said orifice $O_i$ (40) of said separation means (4, 4') are geometrically similar.

17. Distributor-applicator according to claim 1, in which said application means (3) has a non-circular section S, and a shape factor L/l equal to at least 2, where L and l are the largest and the smallest dimensions respectively, said section being taken in a plane perpendicular to said axial direction (10, 21) such that all or part of said translation requires relative orientation of said applicator (3) with respect to said body (2).

18. Distributor-applicator according to claim 1 in which said applicator (3) comprises a single application means A (32), said rod (31) being sufficiently long so that said application means (32) is in contact with said product $P_1$ contained in compartment $C_1$ particularly when said cap (30) closes off said opening (23) of said body (2).

19. Distributor-applicator according to claim 18 in which the height of said application means A (32) is equal to approximately $H_1$, and fills in or closes off said orifice $O_1$.

20. Distributor-applicator according to claim 1 in which said applicator (32) comprises a single application means A, with a height greater than $H_1$, so that it can come into contact with said product $P_1$ contained in the compartment $C_1$ and with said product $P_2$ contained in the compartment $C_2$ when said cap closes off said body, so as to have a zone Ze called the remote zone on the application means after said separation, including collected amounts of products $P_1$ and $P_2$, and a zone Zp called the near zone containing collected products $P_2$ only.

21. Distributor-applicator according to claim 1 in which said applicator comprises at least two application means $A_i$ (32), two separate brushes (320, 320') mounted in series on said rod (31) and possibly as many application means $A_i$ as there are separate compartments $A_1$ and $A_2$ and two separate application means $A_1$ and $A_2$, said application means $A_1$ being in contact with said product $P_1$ contained in compartment $C_1$ when said cap (30) closes off the opening (23) of said body (2), and said application means $A_2$ being in contact with said product $P_2$ contained in the compartment $C_2$ when said cap closes off the opening (23) of said body (2).

22. Distributor-applicator according to claim 21 in which said separate application means $A_i$ (32) have an increasing section in the direction from $A_i$ to $A_{i+1}$, such that each application means $A_i$ only collects the product(s) $P_i$ contained in the corresponding said compartment $C_i$.

23. Distributor-applicator according to claim 21 in which said applicator (3) comprises two axially separate application means $A_1$ and $A_2$, one forming a brush (320) based on bristles, and the other (321) not forming a brush and comprising a material, divided or cellular, capable of collecting a solid or a liquid.

24. Distributor-applicator according to claim 1 in which said rod (31), or possibly said application means (32), cooperates with said separation means (4, 4'), possibly due to a means (33) fixed to said rod (3) or due to a means (6) fixed to said separation means (4, 4') designed to close off said orifice (40) in order to make at least one compartment (200) and said compartment $C_1$ leak tight, when said cap (30) closes off the opening (23) of said body (2).

25. Distributor-applicator according to claim 1 in which said head (22) and/or said bottom (25) of said body (2) form removable parts (22', 25') so that said separation means $S_i$ (4, 4') and/or said products $P_i$ can enter into said cavity (20).

26. Distributor-applicator according to claim 1 in which said body (2) and said separation means are formed by axial assembly, by click-fitting or by gluing or heat sealing, of at least two modular body portions (7) and (7'), one comprising said bottom (25) and the other comprising said opening (23).

27. Distributor-applicator according to claim 1 in which all or some of said body (2) is formed by a transparent moulded plastic material.

28. Use of the distributor-applicator according to claim 1 for packaging several cosmetics $P_i$, at least one of the products $P_i$ being a fluid product.

29. Use according to claim 28 in which said fluid product is a mascara.

30. Use according to claim 28, in which said fluid product is packaged in said compartment (200) $C_1$.

31. Use according to claim 28, in which said products $P_i$ (5), for i>1, comprise agglomerated solid products (51), said solid products (51) forming annular or toroidal bodies (510), comprising a central opening (511) through which said application means (32) can pass.

32. Distributor-applicator (1) mobile in the axial direction (10) designed to contain a cosmetic (5), comprising a body (2) forming a longitudinal cavity (20) with a height (H) along its axial direction (21) containing said cosmetic (5), and in which there is an opening, said body (2) being provided with a lateral skirt (24), fixed with a rim (243) or a head (22) at its top end containing a neck (220) surrounding said opening (23), and forming a bottom (25) at its bottom end, and an applicator (3) comprising a cap (30) forming a means of gripping said applicator (3) and intended to cooperate with said rim (243) or said neck (220) of said head (22), a rod or a longitudinal support (31) and an application means (32), said rod (31) being fixed to said cap (30) at one of its ends, and fixed to said application means (32) at its other end, such that said application means (32), at the contact of said product (5) when said cap closes off said opening (23) of said body (2), collects some of said product (5) and after separation of said applicator (3) from said body (2), including an axial translation, enables application of said collected product on a support, wherein, a) said body (2) comprises an axial partition in said cavity (20) so as to form an axial sequence of N staged compartments (200) in said cavity (20), denoted $C_1$ to $C_N$, where N varies from 2 to 4, each compartment $C_i$ with height $H_i$ containing said cosmetic(s) $P_i$, said cosmetic(s) $P_i$ being different from said cosmetic(s) $P_{i+1}$ in compartment $C_{i+1}$ located above it, and said cosmetic $P_i$ being a fluid product, b) axial partition comprises N−1 separation means S (4, 4'), said separation means S (4, 4') being denoted $S_i$, where i is equal to not more than N−1, between two successive compartments $C_i$ and $C_{i+1}$, c) each compartment $C_i$, where i>1, comprising a volume forming a storage means for said product $P_i$, and also a complementary or free volume (27) forming a communication means, such that said application means (32) can access each of said compartments $C_i$, where i'<i, in order to collect said corresponding products $P_{i'}$, and said separation means $S_i$ (4, 4') comprises a central orifice $O_i$ (40) forming said communication means between the compartments $C_i$ and $C_{i+1}$ and forming an axial passage for said application means (32), said separation means $S_i$ (4, 4') delimiting said compartment $C_i$ near the top and thus forming a partition between said compartments $C_i$ and $C_{i+1}$ of said cavity (20).

* * * * *